United States Patent [19]

Ahrens et al.

[11] Patent Number: 4,539,782

[45] Date of Patent: Sep. 10, 1985

[54] SILO FOR LOOSE MATERIAL IN POWDER FORM

[75] Inventors: Norbert Ahrens, Oelde; Otto Heinemann, Ennigerloh; Heinrich Klockenbusch, Ahlen; Wolfgang Kluger, Beckum, all of Fed. Rep. of Germany

[73] Assignee: Krupp Polysius AG, Beckum, Fed. Rep. of Germany

[21] Appl. No.: 599,652

[22] Filed: Apr. 12, 1984

[30] Foreign Application Priority Data

Apr. 20, 1983 [DE] Fed. Rep. of Germany ..... 3314329

[51] Int. Cl.[3] ..... E04H 7/00

[52] U.S. Cl. ..... 52/192; 52/197; 414/288

[58] Field of Search ..... 52/245, 192, 193–197; 414/288; 222/478, 481

[56] References Cited

U.S. PATENT DOCUMENTS

| | | | |
|---|---|---|---|
| 4,361,254 | 11/1982 | Teraoku et al. | 52/197 X |
| 4,389,142 | 6/1983 | Klein-Albenhausen | 414/288 X |

FOREIGN PATENT DOCUMENTS

| | | | |
|---|---|---|---|
| 1008955 | 5/1957 | Fed. Rep. of Germany | 414/288 |
| 1074850 | 2/1960 | Fed. Rep. of Germany | 414/288 |
| 2352455 | 7/1978 | Fed. Rep. of Germany | 52/192 |
| 2724928 | 12/1979 | Fed. Rep. of Germany | 52/192 |
| 46646 | 4/1977 | Japan | 52/192 |
| 418978 | 2/1967 | Switzerland | 52/196 |
| 838080 | 6/1981 | U.S.S.R. | 52/192 |

*Primary Examiner*—Carl D. Friedman
*Assistant Examiner*—Naoko N. Slack
*Attorney, Agent, or Firm*—Learman & McCulloch

[57] ABSTRACT

A silo for loose material in powder form having a base provided with a central conical section projecting upwards to form an annular discharge zone having floor portions inclined in a direction leading to an opening in a discharge chamber and in such manner that the material flows approximately tangentially towards the material discharge openings.

14 Claims, 8 Drawing Figures

SILO FOR LOOSE MATERIAL IN POWDER FORM

The invention relates to a silo for the mixing and dispersing of loose material in powder form.

BACKGROUND OF THE INVENTION

Silos of the type referred to above are known for example from German Offenlegungsschrift No. 23 52 455 and German Offenlegungsschrift No. 27 24 928. In such known constructions the material discharge openings are arranged in the lower region of the central conical surface, and the annular zone of the base surrounding the conical surface is inclined downwards towards the interior in such a way that the material flows in an approximately radial direction, moving from the outside inwards, towards the material discharge openings.

These known constructions have various disadvantages. Because of the radial direction of flow of the material from the periphery of the silo to the center of the silo, zones which are near the center flow out advantageously whereas the material near the periphery does not flow off satisfactorily even when the base of the silo is inclined near the periphery. Connected with this is the fact that residual emptying of the known silos is often not satisfactory. The mixing of the material is also unsatisfactory when the silo is used for mixing and homogenizing purposes. In the known constructions referred to above it is also essential to provide dosaging or shut-off devices in the discharge channels which are directed radially inwards because the total silo content presses on the material located before the discharge openings and aeration does not guarantee that the material flows off in a controlled manner.

The object of the invention therefore is to provide a silo of the type referred to and which ensures that the material flows uniformly out of all the cross-sectional zones, not only from the zones near the center. In addition, the novel silo should be distinguished by satisfactory residual emptying and a good mixing effect. Finally it should also be possible to dispense with dosaging and shut-off devices if desired and still ensure a uniform discharge of material.

SUMMARY OF THE INVENTION

In the silo according to the invention the material does not flow in a radial direction, but instead flows approximately tangentially towards the material discharge openings, and therefore the previous favoring of the zones near the center is avoided and a uniform flow of material even from the region near the periphery is ensured. In this way satisfactory residual emptying of the silo and, when the silo is used for mixing or homogenizing purposes, a thorough mixing of the material including the material in zones near the periphery is ensured.

DESCRIPTION OF THE DRAWINGS

Further features of the invention are explained in greater detail in connection with the description of a number of embodiments illustrated in the drawings, wherein.

DETAILED DESCRIPTION

Figure 1:
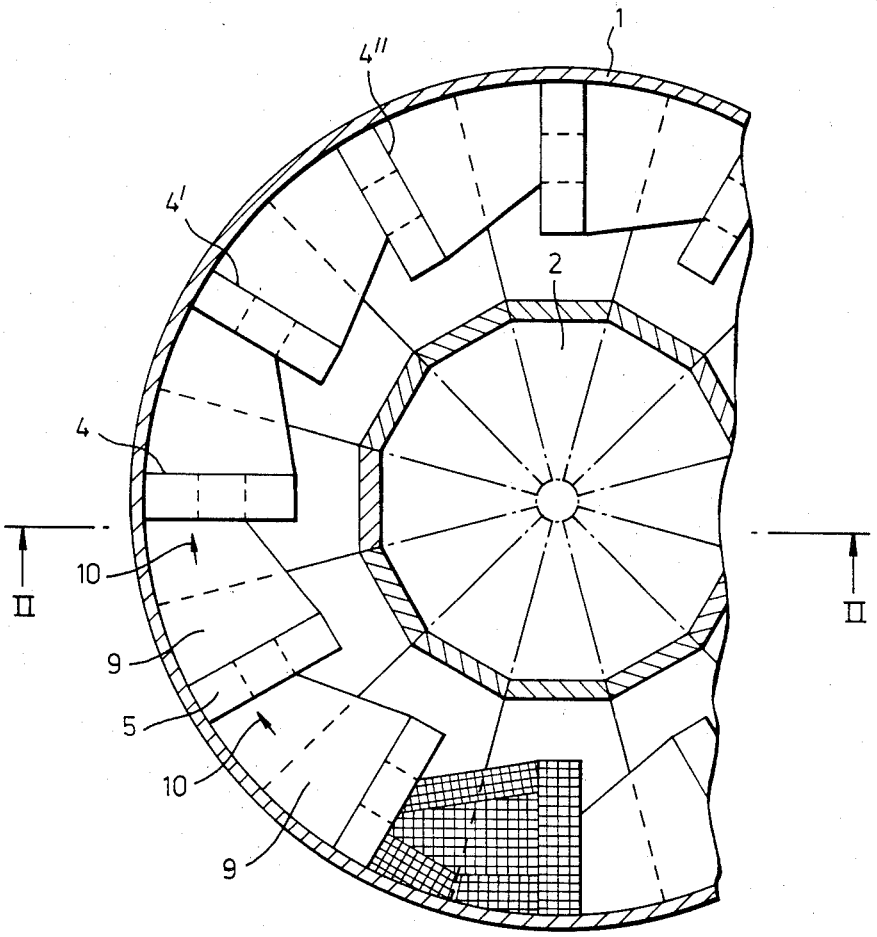
FIG. 1 is a partial plan view of the silo base.
Figure 2:
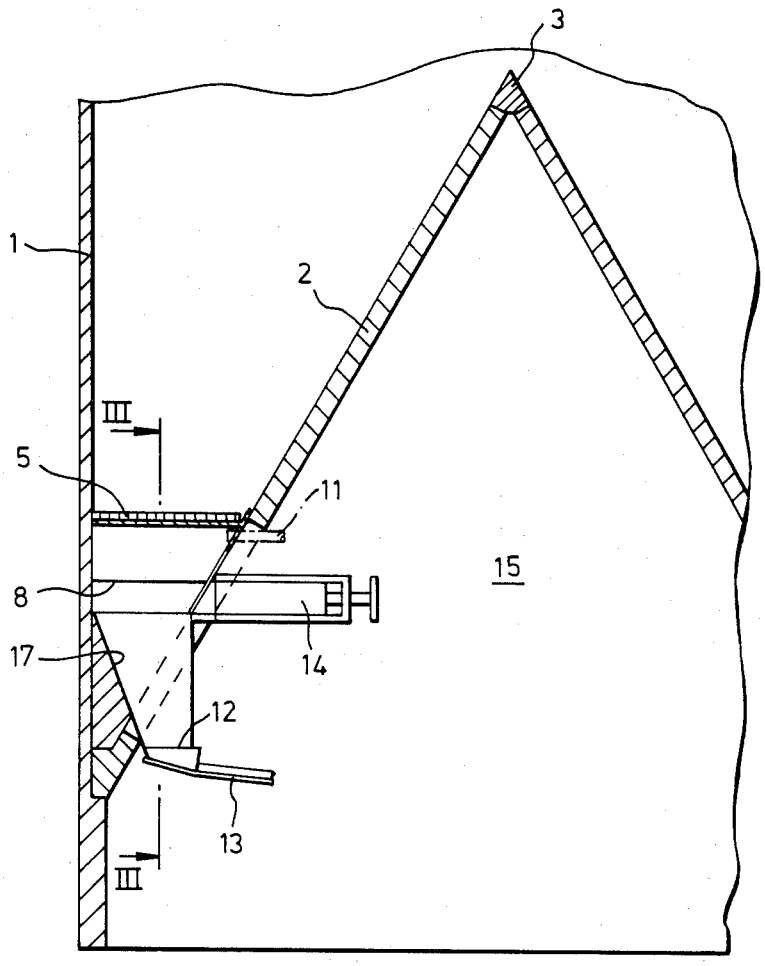
FIG. 2 is a section along the line II—II in FIG. 1.
Figure 3:
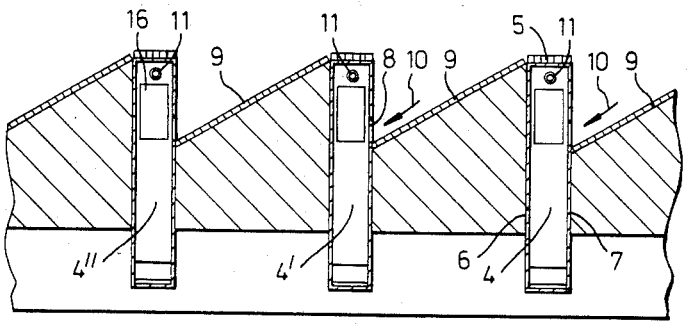
FIG. 3 is a section along the line III—III in FIG. 2.

In the silo for loose material in powder form illustrated in FIGS. 1 to 3 only the lower region which is essential for understanding of the invention is shown. The silo has a round cross-section with a cylindrical outer wall 1 and a silo base the central region of which is formed by an approximately conical section 2. The apex 3 of this conical section points upwards.

A number of discharge chambers 4, 4', 4'' which are aligned approximately radially and are evenly distributed over the periphery of the silo are arranged in the region of the base of the conical section 2. Each of these discharge chambers is defined at the top by an upper cover 5, on the outer periphery by the outer wall 1 of the silo, and laterally by two side walls 6, 7.

A discharge opening 8 through which the material is discharged from the interior of the silo into the chamber 4 is provided in the upper region of one side wall 7. The material discharge opening 8 extends in the radial direction from the central conical section 2 to the cylindrical outer wall 1 of the silo (see FIG. 2).

In the embodiment illustrated in FIGS. 1 to 3, inclined zones 9 of the silo base over which the material flows in the direction of the arrows 10 to the discharge openings 8 are located in the peripheral direction of the silo before the material discharge openings 8 in the direction of the flow of material. In the embodiment according to FIGS. 1 to 3 the zones 9 of the silo base which are inclined in the direction of flow of the material each extend from the upper cover 5 of one discharge chamber (e.g. 4) to the lower edge of the material discharge opening 8 of the discharge chamber (e.g. 4', see FIG. 3) located adjacent thereto in the peripheral direction.

Each discharge chamber 4, 4', 4'' is provided with an air vent connection 11 in its upper region and a material extraction opening 12 in its lower region. Connecting conveyor channels 13 which are merely indicated and which lead to a central outlet (with a bucket wheel valve or dosaging gate valve) can be connected to this material extraction opening 12. However, instead of this arrangement other connections for the material extraction openings 12 of the individual discharge chambers 4, 4', etc. are also possible.

The material discharge openings 8 provided in the side walls of the chambers 4, 4', 4'' can be closed by gate valves 14 which are adjustable in an approximately radial direction. These gate valves 14 can be actuated from the inner chamber 15 within the conical section 2.

In addition a closable opening 16 through which the relevant discharge chamber is accessible from the inner chamber 15 is provided in the inner dividing wall of the discharge chambers 4, 4', 4''.

In the lower region the outer wall of the discharge chambers 4, 4', 4'' is formed by an inclined surface 17 which favors the flow of the material to the material extraction opening 12.

The zones 9 of the silo base which are inclined in the peripheral direction and arranged before the material discharge openings 8 are supplied with air in just the same way as the covers 5 provided on the top of the discharge chambers 4, 4',4''. The zones 9 and the covers 5 can be constructed in one piece if desired.

Figure 4:
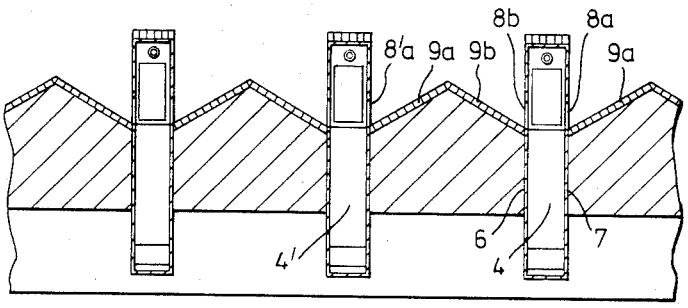
FIG. 4 is a section (corresponding to FIG. 3) through a second embodiment of the invention.

In the variant shown in FIG. 4 each discharge chamber (e.g. 4) is provided with two material discharge openings 8*a*, 8*b* arranged in the upper region of the two side walls 6, 7. The zones 9*a*, 9*b* which are inclined in the direction of flow of the material each extend from a peripheral point lying between two adjacent discharge chambers (e.g. 4, 4', 4''), sloping downwards like a roof to the lower edge of the material discharge openings (e.g. 8*b*, 8'*a*) which face each other of these two discharge chambers 4, 4'. The gate valves associated with the discharge openings 8*a*, 8*b* can be actuated either jointly or individually.

As is clear from the description above, in the silo according to the invention the material flows in a tangential direction into the individual discharge chambers 4, 4', 4'' either from only one side (FIG. 3) or from both sides (FIG. 4). The material extraction opening 12 in the lower region of the discharge chambers 4, 4', 4'' is covered by the upper cover 5 so as to relieve pressure. The interior of the individual discharge chambers is ventilated by means of the air vent connection 11. This prevents undesirably large quantities of aerating air from passing with the material through the material extraction opening 12 into the next apparatus.

The tangential inlets to the individual discharge chambers can be easily closed from the interior chamber 15 by means of the gate valves, for example to enable maintenance work to be carried out in the outlet region.

The gate valves 14 are closed for mixing or homogenizing. The aeration of the material is then carried out zone by zone in a known manner. Mixing takes place both in the peripheral direction and in the radial direction. Subsequent mixing when the material flows out of the silo is not absolutely necessary. The powder can be removed from whichever zone of the silo is being supplied with air.

Because of the chosen form of the material discharge it is possible to empty the silo with practically no residue. If lumps form or material solidifies in the outlet region it can be stirred through openings from the inner chamber 15.

Figure 5:
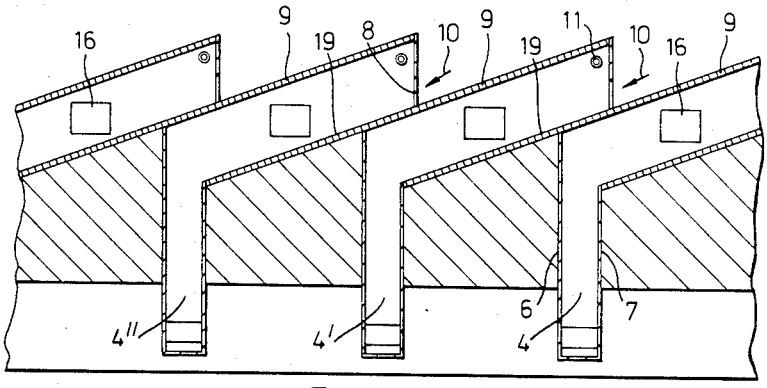
FIG. 5 is a section (corresponding to FIG. 3) through a further embodiment of the invention.

In the third embodiment which is shown in FIG. 5 a zone 19 (which is inclined in the direction of flow) of the discharge chamber 4, 4', 4'' which is covered at the top is connected to a zone 9 of the silo base which is also inclined in the direction of flow and is located before the material discharge openings 8. In this way the discharge chamber has a bent shape and the material passes through the discharge openings 8 without any deflection because in the chosen embodiment the zone 19 has the same inclination as the zone 9. The zone 19 located in the discharge chamber is also advantageously supplied with air.

Figure 6:
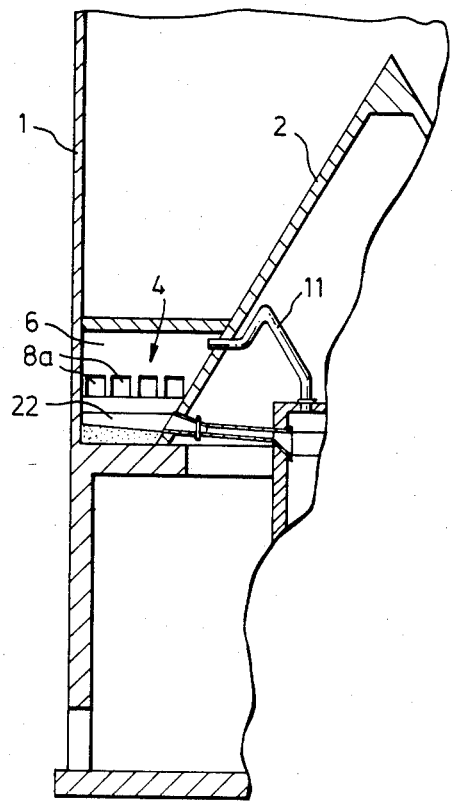
FIGS. 6, 7, and 8 are sections through a further embodiment of the invention, FIG. 6 corresponding substantially to FIG. 2 and FIG. 8 being taken along the line VIII—VIII of FIG. 7.
Figure 7:
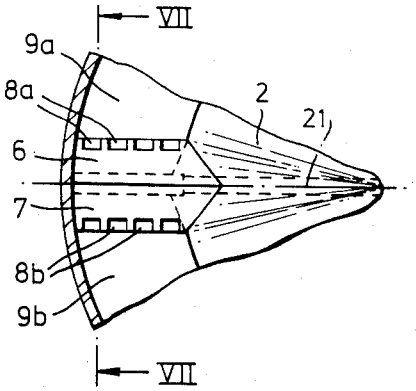
Figure 8:
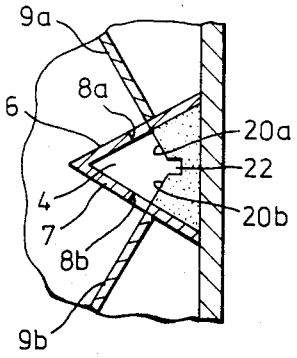

In the further embodiment of the invention shown in FIGS. 6, 7, and 8 the material discharge openings 8*a*, 8*b* are provided in the lower region of the two side walls 6, 7 of discharge chambers 4 which are aligned approximately radially and are constructed as mixing chambers with base ventilation, the side walls 6, 7 being arranged like a roof. A plurality of material discharge openings 8*a*, 8*b* are arranged adjacent to one another in the radial direction in each side wall 6 or 7.

In this embodiment each discharge chamber has a base 20*a*, 20*b* which is inclined towards the central line 21 (which runs in the radial direction) and at the same time is inclined downwards and inwards in the radial direction and is connected with approximately the same inclination and no steps to the zones 9*a*, 9*b* of the silo base which are inclined in the peripheral direction and lie outside the discharge chambers 4. A conveyor channel 22 runs along the central line 21 of the base of the discharge chamber 4.

In this embodiment the material also passes approximately tangentially, but in opposing peripheral directions, through the material discharge openings 8*a*, 8*b* of the two side walls 6, 7 into the discharge chamber 4 where it undergoes intensive mixing and homogenization as a result of the collision of the streams of material coming from opposing peripheral directions and the deflection from the tangential to the radial direction.

What is claimed is:

1. In a loose material silo having a cylindrical wall and a base the central region of which is formed by an upwardly projecting conical section, said base having a number of material discharge openings distributed symmetrically over its periphery between said conical section and said wall, said base having zones between the material discharge openings provided with loose material-supporting inclined surfaces, the improvement wherein said inclined surfaces are inclined peripherally of the silo and toward the material discharge openings in such manner that loose material may flow approximately tangentially of said zones of said base towards the respective material discharge openings.

2. A silo according to claim 1 wherein each of said material discharge openings communicates with a discharge chamber having side walls in which said openings are formed, each of said chambers being provided at its top with a cover.

3. A silo according to claim 2 wherein each of said discharge openings has an upper and a lower edge, and wherein each of said inclined surfaces extends from the cover of one discharge chamber to the lower edge of the discharge opening of an adjacent discharge chamber.

4. A silo according to claim 2 wherein each discharge chamber is provided with a material discharge opening in each of its side walls and wherein said base in each zone between adjacent pairs of discharge chambers has two downwardly inclined surfaces sloping downwards from between adjacent discharge openings to the lower edges of such adjacent material discharge openings.

5. A silo according to claim 2 wherein the covers of the discharge chambers are air permeable.

6. A silo according to claim 2 wherein each discharge chamber has an air vent connection in its upper region and a material extraction opening in its lower region.

7. A silo according to claim 1 wherein the inclined surfaces of said zones are air permeable.

8. A silo according to claim 1 including valve means for selectively opening and closing said discharge openings.

9. A silo according to claim 1 wherein said conical section of said base forms a chamber from which each of said discharge chambers is accessible.

10. A silo according to claim 1 wherein the material discharge openings extend in a radial direction from the conical section to the cylindrical wall.

11. A silo according to claim 1 wherein each inclined surface has an extension extending in prolongation thereof from an associated discharge opening to the associated discharge chamber.

12. A silo according to claim 1 wherein each discharge chamber has two discharge openings communicating therewith at opposite sides thereof, and wherein the inclined surfaces between peripherally adjacent discharge chambers slope in different directions so that loose material may pass approximately tangentially but in opposing peripheral directions through the material discharge openings of each discharge chamber.

13. A silo according to claim 12 wherein each material discharge chamber has two side walls and wherein a plurality of material discharge openings is provided in each side wall.

14. A silo according to claim 12 wherein each discharge chamber has a radially extending base inclined downwardly towards a radially directed central line and also is inclined downwards and radially inwards.

* * * * *